US006414239B1

(12) United States Patent
Gasque, Jr.

(10) Patent No.: US 6,414,239 B1
(45) Date of Patent: Jul. 2, 2002

(54) METHOD AND APPARATUS FOR REDUCING THE MAGNETIC FIELD ASSOCIATED WITH AN ENERGIZED POWER CABLE

(75) Inventor: Samuel N. Gasque, Jr., Hendersonville, NC (US)

(73) Assignee: Mag Holdings, Inc., Hendersonville, NC (US)

( * ) Notice: Subject to any disclaimer, the term of this patent is extended or adjusted under 35 U.S.C. 154(b) by 0 days.

(21) Appl. No.: 09/510,846

(22) Filed: Feb. 23, 2000

(51) Int. Cl.[7] ..... H01B 11/06

(52) U.S. Cl. ..... 174/36; 174/105 R; 174/108; 174/109

(58) Field of Search ..... 174/36, 108, 109, 174/27, 113 R, 113 A, 105 R, 106 R; 340/310.01

(56) References Cited

U.S. PATENT DOCUMENTS

| | | | | | |
|---|---|---|---|---|---|
| 995,588 | A | * | 6/1911 | Cuntz | 174/27 |
| 3,636,234 | A | | 1/1972 | Wakefield | 174/36 |
| 3,813,772 | A | * | 6/1974 | Adams | 174/108 X |
| 3,927,247 | A | * | 12/1975 | Timmons | 174/36 |
| 4,031,310 | A | * | 6/1977 | Jachimowicz | 174/15.1 |
| 4,156,869 | A | * | 5/1979 | Shukantz | 174/108 X |
| 4,738,734 | A | | 4/1988 | Ziemek | 156/53 |
| 4,822,950 | A | | 4/1989 | Schmitt | 174/36 |
| 5,274,712 | A | | 12/1993 | Lindsay et al. | 381/77 |
| 5,349,133 | A | | 9/1994 | Rogers | 174/36 |
| 5,530,203 | A | | 6/1996 | Adams et al. | 174/36 |
| 5,744,755 | A | | 4/1998 | Gasque, Jr. | 174/108 |
| 5,831,210 | A | * | 11/1998 | Nugent | 174/27 |
| 5,929,374 | A | | 7/1999 | Garland | 174/28 |
| 5,930,100 | A | | 7/1999 | Gasque, Jr. | 361/117 |
| 5,936,203 | A | * | 8/1999 | Ryman | 174/109 |

* cited by examiner

*Primary Examiner*—Chau N. Nguyen
(74) *Attorney, Agent, or Firm*—Carter & Schnedler, PA.

(57) ABSTRACT

An electrical power cable is provided, including an elongated carrier in the form of a soft center material hollow conduit. First and second insulated power conductors are spiraled about the conduit, with the first power conductor being spiraled in one direction, and the second power conductor being spiraled in the opposite direction. Preferably, the first and second power conductors cross one another at approximately a 90° angle. When the conductors are energized under load so that current flows through the power conductors, the magnetic field associated with the cable is reduced due to a cancellation effect because the power conductors are spiraled in opposite directions.

20 Claims, 3 Drawing Sheets

METHOD AND APPARATUS FOR REDUCING THE MAGNETIC FIELD ASSOCIATED WITH AN ENERGIZED POWER CABLE

BACKGROUND OF THE INVENTION

This invention relates to power cable. More particularly, it relates to power cable having a reduced magnetic field.

It is known that electrical power cable generates a magnetic field around the cable. The more current that passes through the AC power cable, the larger the magnetic field surrounding the cable. Extension cords or power cords from electrical or electronic components also have a magnetic field surrounding the cable. This magnetic field has been known to contaminate or damage magnetic components, such as audio/videotapes, computer hard drives, floppy disks, etc. Also, it is believed that this magnetic field represents a health hazard to humans if they are in close proximity to the cable and thus are exposed to the magnetic field. One way to reduce the likelihood of this damage or health hazard is to isolate the power cable from components or humans. One way to isolate the power cable is simply to maintain the cable at a substantial distance from components or humans, such as in the case of power transmission lines where the cable is placed on tall towers. Another way to isolate the power cable is to provide shielding about the cable. Shielding techniques are taught in U.S. Pat. Nos. 5,349,133 issued to Rogers and 5,530,203 issued to Adams et al. However, in common household applications, such as the use of extension cords, electrical or AC power cords, or drop wire, isolation of the cable by distance is not practical and isolation of the cable by use of shields adds substantial costs to the cable.

OBJECTS OF THE INVENTION

It is, therefore, one object of this invention to provide an improved power cable.

It is another object of this invention to provide a power cable having a reduced magnetic field about the cable when current flows through the cable.

It is further another object of this invention to provide a natural surge and AC spike suspension down the AC cable.

It is still another object of this invention to provide a reduced magnetic field power cable which is inexpensive to manufacture.

SUMMARY OF THE INVENTION

In accordance with one form of this invention there is provided an electrical power cable, including an elongated carrier. First and second power conductors are provided. Each of the first and second power conductors are electrically insulated. One end of each of the power conductors is adapted to be connected to a source of electrical energy. The other end of each of the power conductors is adapted to be connected to a load. The first power conductor is spiraled about the carrier in one direction. The second power conductor is spiraled about the carrier in the opposite direction to the first power conductor, whereby the magnetic field about the cable caused by current flowing through the power conductors is reduced. Preferably, the carrier is a flexible hollow conduit, round flexible material or cable. Also, preferably, the first conductor is at approximately a 45° angle with respect to the longitudinal axis of the carrier and the second conductor is also at approximately a 45° angle with respect to the longitudinal axis of the carrier so that the first and second conductors cross one another at approximately a 90° angle.

In accordance with another form of this invention, there is provided a method for reducing the magnetic field about an energized power cable by provided an elongated carrier, and first and second insulated power conductors. The first power conductor is spiraled about the carrier in one direction, while the second power conductor is spiraled about the carrier in the opposite direction to the first power conductor. One end of the power conductors are connected to a source of electrical energy and the other end of the power conductors are connected to a load. The magnetic field produced by the current flowing through the first and second power conductors is reduced because the power conductors are spiraled in opposite directions and the magnetic field is cancelled out.

Since the magnetic field associated with power conductors is substantially eliminated, communication cable, including unshielded communication cable, may be placed in close proximity to the power conductors. The teachings of the subject invention may be used to construct a combination power and communication cable by placing a communication cable within the carrier. In the case where the carrier is a hollow conduit, the communication cable may be placed within the conduit.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENTS

Figure 1:
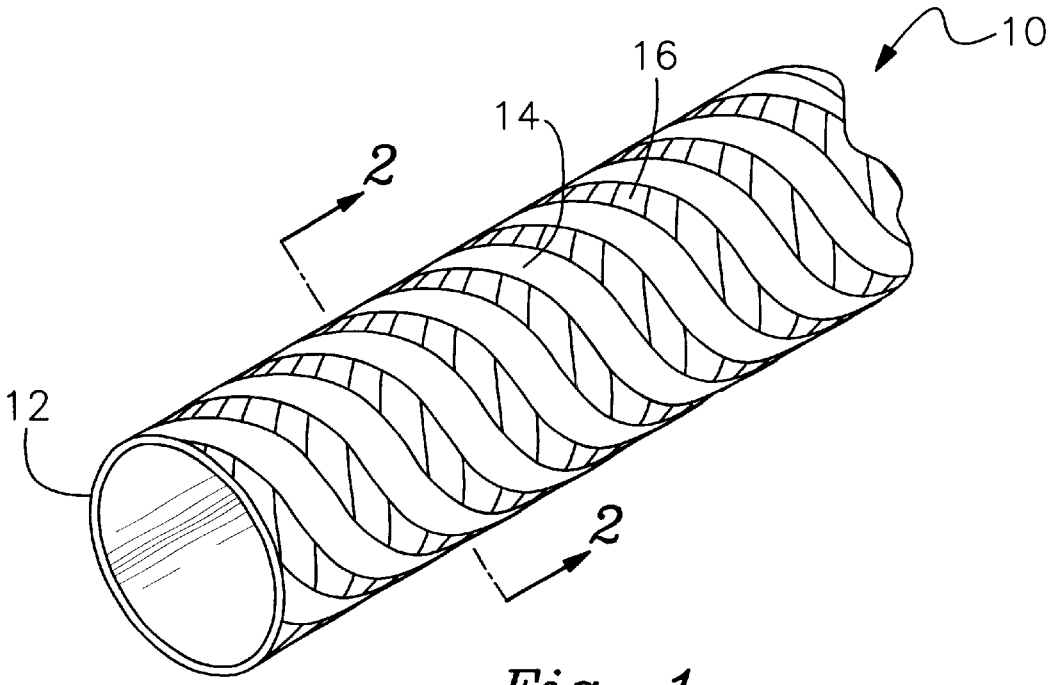
FIG. 1 is partial perspective view of the cable of the subject invention.

Referring now more particularly to FIG. 1, there is provided an electrical power cable 10, including an elongated carrier which may be in the form of hollow conduit 12. Preferably, conduit 12 is made of a flexible material. As used herein, conduit shall include a flexible cable. The carrier may be hollow or solid and is preferably flexible. Cable 12 includes insulated wires 14 and 16, which are preferably flat.

Figure 2:
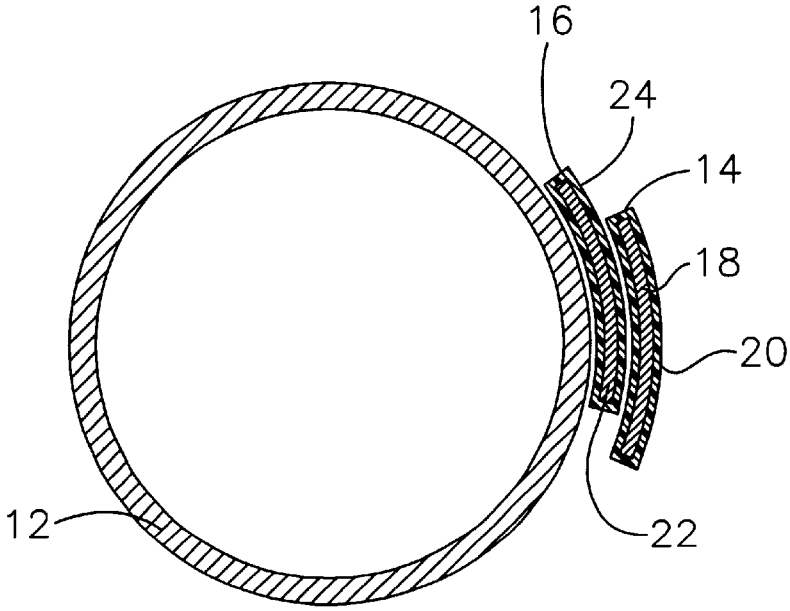
FIG. 2 is a sectional view of the cable of FIG. 1 taken through Section Line 2—2.

As can be seen from FIG. 2, insulated wire 14 includes flat conductor 18, which is insulated by insulation 20. Insulated wire 16 included flat conductor 22, which is insulated by insulation 24. The insulated conductors 14 and 16 are spiraled conduit 12 at approximately a 45° angle with respect to the longitudinal axis of conduit 12. Thus the insulated conductors 14 and 16 cross one another along the length of conduit 12 at angles of approximately 90°. By spiraling conductors 14 and 16 in opposite directions about conduit 12 at approximately 90° angles with respect to one another, it has been shown that magnetic fields generated by the conductors when current passes therethrough are substantially reduced due to a cancellation affect. That is, the magnetic field from cable 14 cancels a portion of the magnetic field from cable 16 and vice-a-versa.

Figure 3:
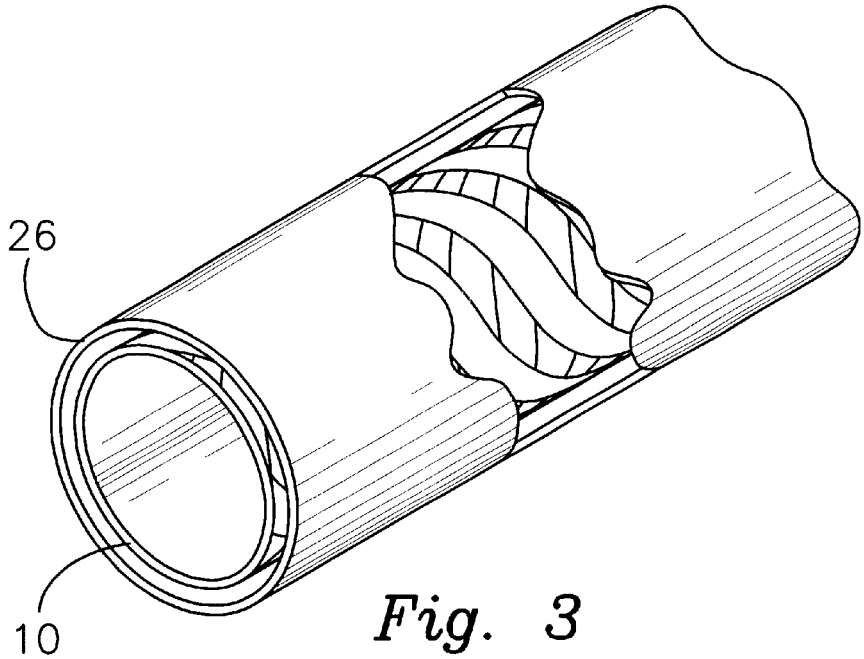
FIG. 3 is a partial perspective view of an alternative embodiment to the embodiment of FIG. 1.

FIG. 3 shows an alternative embodiment of that of FIG. 1, whereby the cable 10 of FIG. 1 is placed inside an overall jacket 26 for protection.

Cable 10 is similar in construction to the lightning retardant cable described in U.S. Pat. No. 5,930,100 issued to Gasque, with the primary difference being that the cable 10, in this embodiment, does not have conductors inside conduit 12 and the spiraled conductors in the Gasque patent are not specifically designed to be power conductors.

Tests have been performed on lightning retardant cable which is described in U.S. Pat. No. 5,930,100 issued to Gasque.

Figure 4:
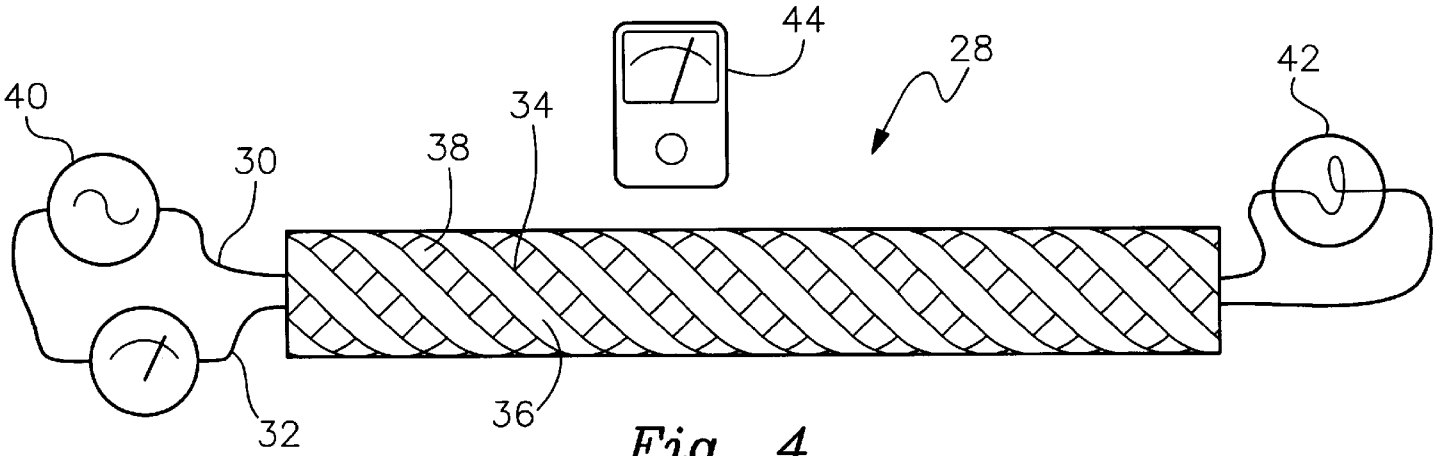
FIG. 4 is a plan view showing a test set up of a cable which is similar to the cable of FIG. 1 except that is has inner conductors as well as outer conductors and power is applied to the inner conductors.
Figure 5:
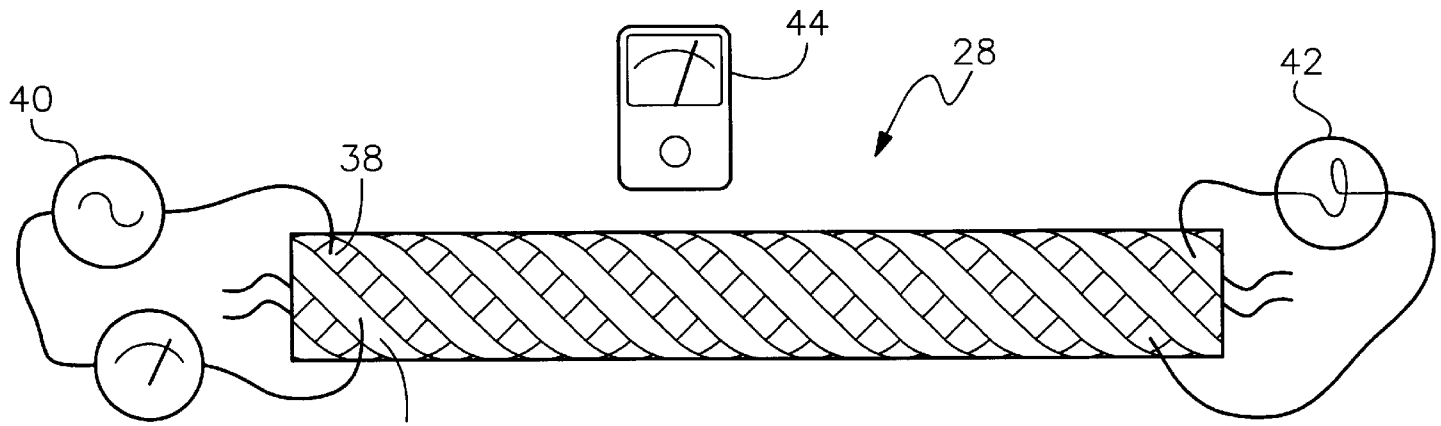
FIG. 5 is a plan view of a test set up to test a cable which is similar to the cable of FIG. 1 except that it has inner conductors as well as outer conductors and power is applied to the outer conductors.

The tests were performed using a 180'length of deep well pump cable 28 shown in FIGS. 4 and 5. Test cable 28 includes a first power conductor 30 and a second power conductor 32 surrounded by jacket 34. Power conductors 30 and 32 are twisted down the center of the cable. A pair of insulated conductors 36 and 38 are spiraled about the outside of jacket 34 along the length of the cable 28, which were designed to serve as a lightning suppressant and were not designed as the normal current carrying conductors of the cable. In the test set up shown in FIG. 4, electrical energy source 40 was connected to one end of inner conductors 30 and 32, with an ampmeter connected between conductor 32 and the energy source 40. The other ends of conductors 30 and 32 were connected to a 100 watt light bulb 42, which served as a load. A magnetic tri-field meter 44 was placed directly on top of cable 28. With 80 milliamps of 60 Hz current flowing through conductors 30 and 32, the magnetic tri-field meter detected AC magnetic field of 2.5 milligauss at its highest point.

The test was repeated with the same cable 28 in the set up shown in FIG. 5, which is identical to the setup shown in FIG. 4, except that electrical energy source 40 was connected to the outer spiraled conductors 36 and 38. With 80 milliamps of 60 Hz current flowing through conductors 36 and 38, the magnetic field measured by the magnetic tri-field meter was 0.2 milligauss.

The same setups were used in FIGS. 4 and 5 were repeated using an electrical saw as a load in lieu of light bulb 42. The saw drew 3.5 amps at 118 volts. Using the saw with the setup of FIG. 4, the magnetic field was measured at over 20 milligauss, i.e., where the current flowed through the wires flowing through the center of the cable. However, using the setup of FIG. 5, i.e., where the current flowed through the spiraled conductors on the outside of the cable, less than 2 milligauss was measured. Thus by using Applicant's invention more than a ten fold decrease in the magnetic field has been observed.

Figure 6:
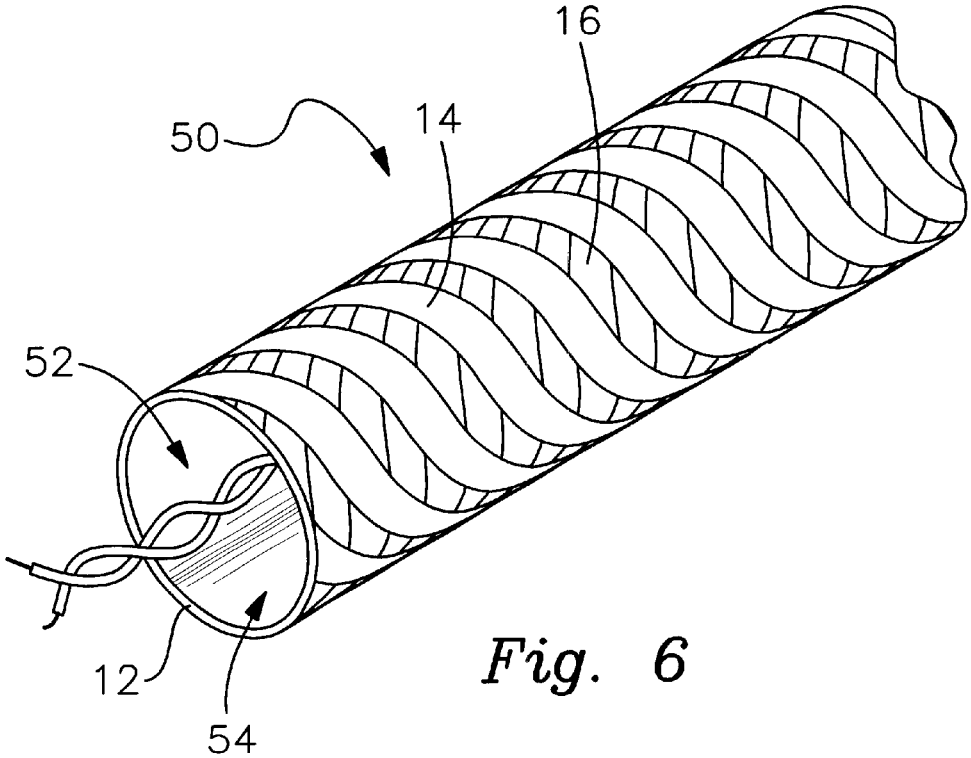
FIG. 6 is a partial perspective view of a cable showing yet another alternative embodiment of the invention.

FIG. 6 shows an alternative embodiment of the invention, wherein a combination power and communication cable 50 is provided. Cable 50 is identical to cable 10, shown in FIG. 1, except twisted pair communication conductors 52 are received on the inside 54 of hollow conduit 12. Since the crossing of conductors 14 and 16 substantially eliminates the magnetic field on the inside 54 of conduit 12, communication conductors 52 may be provided in close proximity to power conductors 14 and 16 without the fear of magnetic interference. Thus, the inside 54 of conduit 12 provides neutral "dead" space that can be used for audio/video communications or control wires or any other applications without the fear of magnetic interference due to current flow through power conductors 14 and 16.

Applicant's invention may be used for at least the following applications: power cables for houses, business or industry (outside); inside wiring for commercial, industrial or consumer application, such as businesses or houses; electrical cords; extension cords; computer and computer ready power cords; audio/video power cords; surge protectors or multiple socket power strips; marine or underwater applications; aerospace or aviation applications; outer space applications; integrated circuit applications; and circuit board applications.

In addition to reducing or eliminating dangerous magnetic fields, the invention offers a natural surge and spike protection due to the choke action of the spiralled power conductors. Furthermore, it is believed that with this spiralled conductor design, that the resistance in the individual conductors decreases.

From the foregoing description of the preferred embodiments of the invention, it will be apparent that many modifications may be made therein. It will be understood, however, that the embodiments of the invention are exemplifications of the invention only and that the invention is not limited thereto. It is to be understood therefore that it is intended in the appended claims to cover all modifications as fall within the true spirit and scope of the invention.

What is claimed is:

1. An electrical power cable comprising:

an elongated carrier;

first and second power conductors; each of said first and second power conductors being electrically insulated;

one end of said power conductors adapted to be connected to a source of electrical energy;

the other end of said power conductors adapted to be connected to a load;

each of said power conductors constructed so as to be able to deliver sufficient electrical current to operate said load, and a magnetic field will arise about the cable when current flows in the power conductors;

said first power conductor spiraled about said carrier in one direction;

said second power conductor spiraled about said carrier in the opposite direction to the first power conductor, whereby the magnetic field about said cable when current flows through said power conductors is reduced.

2. A cable as set forth in claim 1, wherein said carrier is a hollow conduit.

3. A cable as set forth in claim 1, wherein said carrier is an elongated cylinder.

4. A cable as set forth in claim 1, further including a jacket surrounding said conductors and said carrier.

5. A cable as set forth in claim 1, wherein said conductors are substantially flat.

6. A cable as set forth in claim 1, wherein said first conductor is approximately 45° with respect to the longitudinal axis of said carrier; said second conductor is approximately 45° with respect to the longitudinal axis of said carrier.

7. A cable as set forth in claim 1, wherein said first conductor and said second conductor cross one another at spaced intervals along the length of said carrier at approximately 90° angles.

8. A method for reducing the magnetic field about an energized power cable comprising the steps of:

providing an elongated carrier, and first and second insulated power conductors; said first power conductor being spiraled about said cable in one direction; said second power conductor being spiraled about said cable in the opposite direction to said first conductor;

connecting one end of said conductors to a source of electrical energy;

connecting the other end of said conductors to a load; each of said power conductors constructed so as to be able to deliver sufficient electrical current to operate said load, and a magnetic field will arise about the cable when current flows in the power conductors, whereby the magnitude of the magnetic field produced by current flowing through said first and second conductors is reduced.

9. A method as set forth in claim 8, wherein said carrier is a hollow conduit.

10. A method as set forth in claim 8, wherein said carrier is an elongated cylinder.

11. A method as set forth in claim 8, further including a jacket surrounding said conductors and said carrier.

12. A method as set forth in claim 8, wherein said conductors are substantially flat.

13. A method as set forth in claim 8, wherein said first and second conductors are located approximately 45° with respect to the longitudinal axis of said carrier.

14. A method as set forth in claim 8, wherein said first conductor and said second conductor cross one another along the length of said carrier at angles of approximately 90°.

15. A combination power and communication cable comprising:

an elongated carrier;

first and second power conductors; each of said first and second power conductors being electrically insulated;

one end of said power conductors adapted to be connected to a source of electrical energy;

the other end of said power conductors adapted to be connected to a load;

each of said power conductors constructed so as to be able to deliver sufficient electrical current to operate said load, and a magnetic field will arise about the cable when current flows in the power conductors;

said first power conductor spiraled about said carrier in one direction;

said second power conductor spiraled about said carrier in the opposite direction to the first power conductor, whereby the magnetic field about said cable when current flows through said power conductors is reduced;

at least one communication conductor received within said carrier.

16. A cable as set forth in claim 15, wherein said carrier is a hollow conduit.

17. A cable as set forth in claim 15, wherein said carrier is an elongated cylinder.

18. A cable as set forth in claim 15, wherein said conductors are substantially flat.

19. A cable as set forth in claim 15, wherein said first conductor is approximately 45° with respect to the longitudinal axis of said carrier; said second conductor is approximately 45° with respect to the longitudinal axis of said carrier.

20. A cable as set forth in claim 15, wherein said first conductor and said second conductor cross one another at spaced intervals along the length of said carrier at approximately 90° angles.

* * * * *